US010341780B2

(12) United States Patent
Wang et al.

(10) Patent No.: US 10,341,780 B2
(45) **Date of Patent: *Jul. 2, 2019**

(54) MINIATURE SPEAKER

(71) Applicant: Goertek Inc., Shandong (CN)

(72) Inventors: Zhibing Wang, Shandong (CN); Gang Chen, Shandong (CN); Minghui Shao, Shandong (CN); Guanglei Liu, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/740,440

(22) PCT Filed: Dec. 10, 2015

(86) PCT No.: PCT/CN2015/096964

§ 371 (c)(1),
(2) Date: Dec. 28, 2017

(87) PCT Pub. No.: WO2017/000504

PCT Pub. Date: Jan. 5, 2017

(65) Prior Publication Data

US 2018/0192202 A1 Jul. 5, 2018

(30) Foreign Application Priority Data

Jul. 1, 2015 (CN) ..... 2015 2 0465782 U

(51) Int. Cl.
*H04R 1/02* (2006.01)
*H04R 1/28* (2006.01)
(Continued)

(52) U.S. Cl.
CPC ..... *H04R 9/06* (2013.01); *H04R 1/02* (2013.01); *H04R 7/16* (2013.01); *H04R 31/003* (2013.01);
(Continued)

(58) Field of Classification Search
CPC ..... H04R 1/02; H04R 1/28; H04R 1/2869; H04R 1/2873; H04R 1/2876; H04R 1/086; H04R 1/025; H04R 1/026
(Continued)

(56) References Cited

U.S. PATENT DOCUMENTS 5,701,355 A * 12/1997 Brannan ..... H04R 1/08 174/653
6,002,949 A * 12/1999 Hawker ..... H04M 1/0202 361/814
(Continued)

FOREIGN PATENT DOCUMENTS

CN 103354629 A 10/2013
CN 203883990 U 10/2014
(Continued)

OTHER PUBLICATIONS

International Search Report and Written Opinion of the International Searching Authority for International Patent Application No. PCT/CN2015/096964 dated Apr. 15, 2017, with English translation of the search report, 10 pages.

*Primary Examiner* — Suhan Ni
(74) *Attorney, Agent, or Firm* — Alston & Bird LLP

(57) ABSTRACT

A miniature speaker comprises a first housing body and a second housing body, which are combined together. A vibrating system and a magnetic circuit system are accommodated in a space defined by the first housing body and the second housing body. The miniature speaker is characterized in that the sidewall at the end of the second housing body, which is combined with the first housing body, surrounds the periphery of the first housing body; a gap is provided between the outer edge of the first housing body and the inner side of the sidewall of the second housing body; the miniature speaker further comprises a sealing member which covers the first housing body, and the edge of the
(Continued)

sealing member is located in the gap, which makes the gap between the first housing body and the second housing body sealed.

19 Claims, 3 Drawing Sheets

(51) Int. Cl.
*H04R 9/06* (2006.01)
*H04R 7/16* (2006.01)
*H04R 31/00* (2006.01)
*H04R 9/02* (2006.01)

(52) U.S. Cl.
CPC ..... *H04R 9/025* (2013.01); *H04R 31/006* (2013.01); *H04R 2307/025* (2013.01); *H04R 2400/11* (2013.01); *H04R 2499/11* (2013.01); *H04R 2499/15* (2013.01)

(58) Field of Classification Search
USPC ..... 381/333–334, 345–346, 353, 359, 388
See application file for complete search history.

(56) References Cited

U.S. PATENT DOCUMENTS

| | | | | |
|---|---|---|---|---|
| 8,213,659 | B2 * | 7/2012 | Mottonen | H04M 1/035 381/345 |
| 8,542,852 | B2 * | 9/2013 | Kageyama | B06B 1/0292 381/173 |
| 9,020,180 | B2 * | 4/2015 | Levinsohn | H04R 1/04 381/122 |
| 2006/0140423 | A1 * | 6/2006 | Tanabe | H04R 19/016 381/174 |
| 2013/0070956 | A1 | 3/2013 | Yamanaka | |
| 2015/0358705 | A1 * | 12/2015 | Chen | H04R 1/2842 381/386 |

FOREIGN PATENT DOCUMENTS

| | | | |
|---|---|---|---|
| CN | 204131709 | U | 1/2015 |
| CN | 204733358 | U | 10/2015 |
| CN | 204761683 | U | 11/2015 |

* cited by examiner

MINIATURE SPEAKER

CROSS-REFERENCE TO RELATED APPLICATIONS

This application is a National Stage Application, filed under 35 U.S.C. § 371, of International Application No. PCT/CN2015/096964, filed on Dec. 10, 2015, which international application claims priority to Chinese Patent Application No. 201520465782.6, filed on Jul. 1, 2015, the contents of both of which as are hereby incorporated by reference in their entireties.

BACKGROUND

Related Field

The present invention relates to the technical field of electro-acoustic products, and in particular, to a miniature speaker.

Description of Related Art

A miniature speaker is an important acoustic component of a portable electronic device, which is used to complete the conversion between electrical signals and sound signals and is an energy conversion device. Existing miniature speakers usually comprise a housing which is usually formed by combining at least two housing bodies, wherein a vibration system and a magnetic circuit system are accommodated in a space defined by the housing bodies together. At present, the sealed combination between the housing bodies is usually achieved by ultrasonic welding sealing or adhesive sealing, and the two processes can meet the basic waterproof requirements of miniature speakers. However, with the continuous development of the electronic technology, the various functions of portable electronic devices are becoming more and more demanding, and the requirement for waterproofing has been greatly raised.

With the increasing requirement for waterproofing of the portable electronic device, the miniature speaker, which is the main acoustic component of the portable electronic device, is easily damaged by water droplets entering a sound hole due to its mounting on the sound hole of the portable electronic device. Therefore, the waterproof requirement for the miniature speaker has also been raised. When the miniature speaker is subjected to a waterproof test, the water pressure borne by the miniature speaker is increased by 5 bar (pressure intensity unit, 1 bar=0.1 MPa), which makes the existing miniature speaker subjected to ultrasonic welding sealing or adhesive sealing cannot pass the waterproof test of this pressure intensity. At the same time, these two kinds of sealing methods still have the following defects.

In the ultrasonic welding sealing process, with the continuous decrease of the volume of the miniature speaker, the ultrasonic structure has been restricted in its setting. The small selection margin will lead to the instability of the ultrasonic state, which is mainly manifested as poor sealing property caused by a bad ultrasonic state in the local area.

In the adhesive sealing process, the production efficiency is low, the state is difficult to control, local cracking and other undesirable effects are easily caused, the sealing property is poor and excessive glue easily occurs, resulting in unaesthetic appearance of the miniature speaker.

BRIEF SUMMARY

In view of the above defects, the technical problem to be solved by the present invention is to provide a miniature speaker which has good sealing property between housing bodies and can pass a waterproof test of high pressure intensity.

In order to solve the above-mentioned technical problems, the technical solution of the invention is as follows.

A miniature speaker comprises a first housing body and a second housing body, which are combined together, wherein a vibrating system and a magnetic circuit system are accommodated in a space defined by the first housing body and the second housing body; the sidewall at the end of the second housing body, which is combined with the first housing body, surrounds the periphery of the first housing body; a gap is provided between the outer edge of the first housing body and the inner side of the sidewall of the second housing body; the miniature speaker further comprises a sealing member which covers the outer side of the first housing body, and the edge of the sealing member is located in the gap, which makes the gap between the housing bodys sealed.

A steel sheet is arranged in a position, which corresponds to the vibrating system, of the first housing body; the sealing member covers the outer side of the steel sheet; a melting temperature of the material of the sealing member is lower than that of a material of the first housing body and the second housing body.

The outer surface of the first housing body is lower than the end surface of the sidewall of the second housing body; the outer surface of the sealing member is flush with the end surface of the sidewall of the second housing body.

The sealing member is formed through an injection molding process after the first housing body and the second housing body are combined.

A recess portion is arranged at the edge of the inner surface of the first housing body, and a space for accommodating adhesive is formed between the recess portion and the second housing body.

A combination portion which is of an annular step structure is arranged on the inner surface of the sidewall of the second housing body, and an ultrasonic wire which is ultrasonically combined with the second housing body is arranged in a position, which corresponds to the combination portion, of the inner surface of the first housing body.

The sealing member is made of one of silicone, TPU, TPC or TPR.

The magnetic circuit system comprises a magnetic conduction plate; an inner magnet and a lateral magnet are fixed on the magnetic conduction plate; an inner washer and a lateral washer are respectively fixed on the inner magnet and the lateral magnet; the lateral washer is of an annular structure; supporting portions which extend towards the magnetic conduction plate are arranged at the edges of two opposite sides of the lateral washer; and a position, which corresponds to the supporting portion, at the edge of the magnetic conduction plate is provided with a notch which is adaptive to the end part of the supporting portion.

The vibrating system comprises a vibrating assembly which is combined with the second housing body; a voice coil is fixed to one side of the vibrating assembly close to the magnetic circuit system; and the vibrating assembly comprises a silicone vibrating diaphragm which is combined with the second housing body through an injection molding process.

A sunken make-way portion is arranged in a position, which corresponds to the lead of the voice coil, of the magnetic conduction plate.

After the above technical solution is adopted, the speaker module of the present invention has the beneficial effects.

The miniature speaker of the present invention comprises the first housing body and the second housing body, which are combined together; the sidewall at the end of the second housing body, which is combined with the first housing body, surrounds the periphery of the first housing body; the gap is provided between the outer edge of the first housing body and the inner side of the sidewall of the second housing body; the miniature speaker further comprises the sealing member which covers the outer side of the first housing body, and the edge of the sealing member is located in the gap, which makes the gap between the housing bodys sealed. The sealing member which is additionally arranged between the first housing body and the second housing body can completely fill the gap between the first housing body and the second housing body, remedy the defect of poor local sealing therebetween and effectively enhance the sealing property therebetween. After the sealing member is additionally arranged, the miniature speaker of the present invention can completely pass the waterproof test of high pressure intensity and meet the high requirement of the miniature speaker for the waterproof performance.

The steel sheet is arranged in a position, which corresponds to the vibrating system, of the first housing body; the sealing member covers the outer side of the steel sheet; the melting temperature of the material of the sealing member is lower than that of the material of the first housing body and the second housing body. The steel sheet reduces the overall thickness of the miniature speaker while meeting the strength of the housing bodies of the miniature speaker. At the same time, the melting temperature of the material of the sealing member is lower than the melting temperature of the material of the housing bodies, that is, the material of the sealing member is soft, has certain elasticity and compressibility, and can act as a buffer when the miniature speaker is installed in the portable electronic device, such that the miniature speaker and the portable electronic device are closely connected to prevent water droplets entering the sound hole from entering the portable electronic device more effectively, thereby improving the waterproof performance of the portable electronic device.

The sealing member is formed through an injection molding process after the first housing body and the second housing body are combined. The sealing member is combined to the first housing body and the second housing body directly by injection molding, thereby enhancing the combination strength between the sealing member and the first and second housing bodies, further improving the sealing property of the miniature speaker at the same time, reducing the assembly difficulty of the miniature speaker and improving the production efficiency and the appearance aesthetics.

A combination portion which is of an annular step structure is arranged inner the sidewall of the second housing body, and the ultrasonic wire which is ultrasonically combined with the second housing body is arranged in a position, which corresponds to the combination portion, of the inner surface of the first housing body. The ultrasonic wire is set such that the first housing body and the second housing body can be attached to each other sufficiently when being ultrasonically combined, the combination strength between the two housing bodies is improved, and meanwhile an injection molding material is prevented from entering an inner cavity of the miniature speaker while the sealing member is injection-molded, thereby ensuring the acoustic performance of the miniature speaker and improving the qualified rate of the product.

From the above, the miniature speaker of the present invention solves the technical problems that the miniature speaker in the prior art has poor sealing property and cannot meet higher waterproof requirement, and the like. The miniature speaker of the present invention has high sealing property, can pass a waterproof test of high pressure intensity and is high in production efficiency and aesthetic in appearance at the same time.

The reference signs in drawings represent the following components: 10—first housing body; 12—ultrasonic wire; 14—protrusion portion; 16—recess portion; 20—second housing body; 22—sound hole; 24—combination portion; 30—dome; 32—vibrating diaphragm; 34—voice coil; 340—lead; 40—lateral washer; 400—supporting portion; 42—inner washer; 44—lateral magnet; 46—inner magnet; 48—magnetic conduction plate; 480—make-way portion; 482—notch; 50—sealing member; 60—electric connector; 70—steel sheet.

DETAILED DESCRIPTION OF VARIOUS EMBODIMENTS

The present invention will be further described as below in conjunction with drawings and embodiments.

The inner side involved in this description refers to the side near the center of a housing, and the outer side refers to the side far from the center of the housing.

Figure 1:
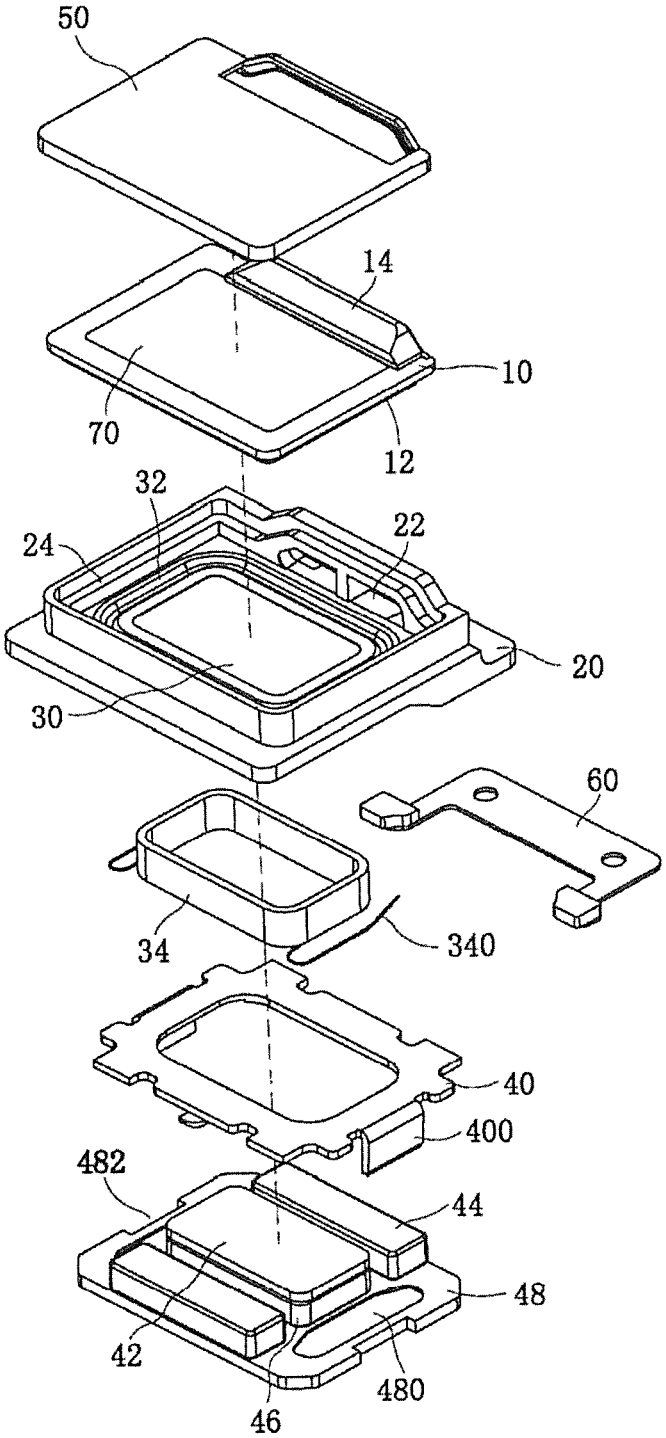
FIG. 1 is an exploded schematic structural view of the miniature speaker of the present invention.
Figure 2:
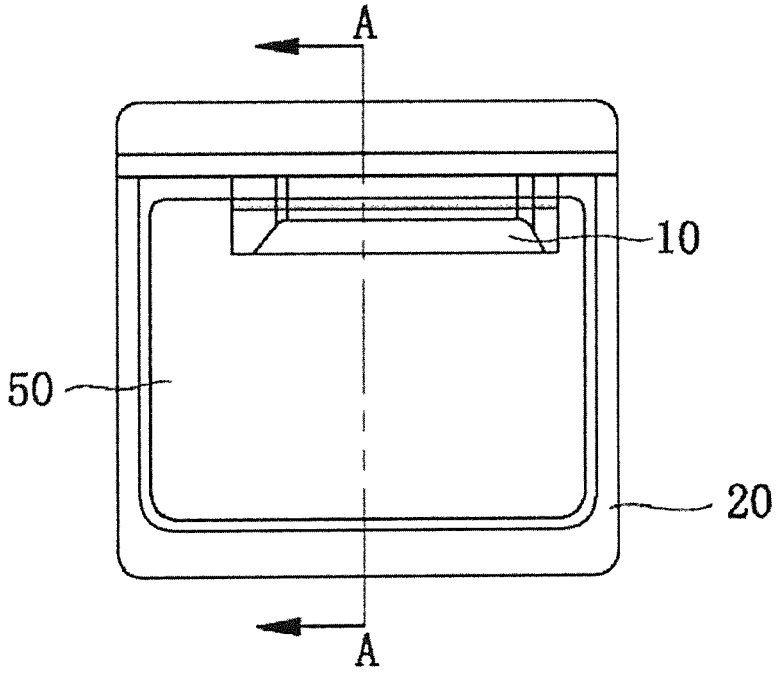
FIG. 2 is a combination view of FIG. 1.
Figure 3:
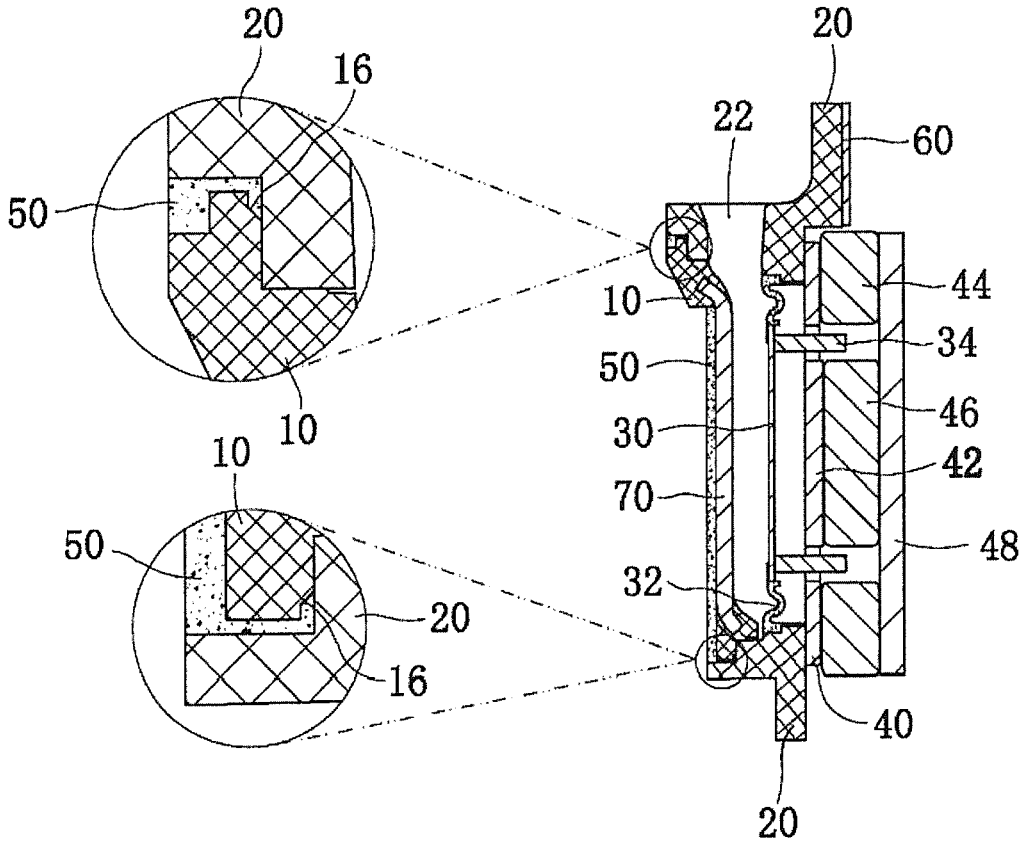
FIG. 3 is a sectional view of line A-A in FIG. 2.

As shown in FIGS. 1, 2 and 3 together, a miniature speaker is of a rectangular structure and comprises a housing. The housing is composed of a first housing body 10 and a second housing body 20 which are combined together. A vibrating system and a magnetic circuit system are accommodated in a space defined by the first housing body 10 and the second housing body 20. An inner cavity of the miniature speaker is separated by the vibrating system to form two cavities, i.e., a front acoustic cavity and a rear acoustic cavity. The first housing body 10 and the second housing body 20 are injection-molded housing bodies. A steel sheet 70 is combined to a position, which corresponds to the vibrating system, of the first housing body 10 by injection molding. The steel sheet 70 effectively reduces the overall height of the miniature speaker while ensuring the strength of the first housing body 10, such that the miniature speaker adapts to the thinner development requirement.

As shown in FIGS. 1 and 3 together, the second housing body 20 is of an annular structure with two ends being open. The first housing body 10 is combined to one end of the second housing body 20 close to the front acoustic cavity, and the sidewall at this end of the second housing body 20 surrounds the periphery of the first housing body 10. The outer surface of the first housing body 10 is lower than the end surface of the sidewall of the second housing body 20, and an annular gap is arranged between the outer edge of the first housing body 10 and the inner side of the sidewall of the second housing body 20. The miniature speaker further comprises a sealing member 50 which wraps the first housing body 10, and the edge of the sealing member 50 is located in the gap, which makes the gap between the housing bodys sealed. The distance, which is more than 0.1 mm generally, between the outer surface of the first housing body 10 and the end surface of the sidewall of the second housing body 20 should be lower than the minimum thickness of the sealing member 50. The outer surface of the sealing member 50 after combination is flush with the end surface of the side wall of the second housing body 20. The sidewall at one side of the second housing body 20 is provided with a sound hole 22 which is communicated with the front acoustic cavity. The sidewall at the side where the sound hole 22 is provided is relatively higher, and protrudes upwards. The position, which corresponds to the sound hole 22, of the first housing body 10 is provided with an upward protrusion portion 14. The position, which corresponds to the protrusion portion 14, of the sealing member 50 is provided with an open hole. The protrusion portion 14 is exposed outside the open hole.

As shown in FIG. 3, the sealing member 50 is formed through an injection molding process after the first housing body 10 and the second housing body 20 are combined. The melting temperature of the material of the sealing member 50 is lower than that of the material of the first housing body 10 and the second housing 20. In the present embodiment, the material of the sealing member 50 is preferably one of silicone, TPU (Thermoplastic Polyurethanes), TPC (Thermoplastic Composites), or TPR (Thermoplastic Rubber), but is not limited to the above four materials. A material can be used as the material of the sealing member 50 as long as it is soft in texture, compressible and elastic and can be formed through the injection molding process. The soft sealing member 50 covers the steel sheet 70 and acts as a buffer that allows the miniature speaker to be more closely combined with the portable electronic device.

As shown in FIG. 1, a combination portion 24, which is of an annular step structure, is arranged on the inner surface of the sidewall of the second housing body 20. The surface of the combination portion 24 is lower than the end surface of the sidewall. An annular ultrasonic wire 12 is arranged in a position, which corresponds to the combination portion 24, of the inner surface of the first housing body 10. The first housing body 10 and the second housing body 20 are combined through an ultrasonic welding process. The ultrasonic wire 12 is arranged so that the first housing body 10 and the second housing body 20 are sufficiently attached to each other when being combined, to prevent an injection molding material from flowing into the front acoustic cavity when the sealing member 50 is injection-molded, thereby ensuring the acoustic performance of the miniature speaker.

As shown in FIG. 3, the edge, which is in contact with the combination portion 24, of the inner surface of the first housing body 10 is provided with a recess portion 16, in other words, the thickness of the edge of the first housing body 10 is less than the thickness of other positions. A space for accommodating adhesive is formed between the recess portion 16 and the combination portion 24. The recess portion 16 is arranged to expand the space of the gap between the first housing body 10 and the second housing body 20, thereby increasing the contact area between the sealing member 50 and the first and the second housing body 10 and 20, and enhancing the sealing property. In addition, the sealing member 50 located between the recess portion 16 and the combination portion 24 is pressed to the inner side of the first housing body 10 to effectively prevent the sealing member 50 from falling from the position between the first housing body 10 and the second housing body 20, thereby improving the stability of the waterproof property of the miniature speaker.

As shown in FIG. 1 and FIG. 3 together, the vibrating system comprises a vibrating assembly and a voice coil 34. The vibrating assembly comprises an annular vibrating diaphragm 32 whose outer edge is combined with the second housing body 20 by injection molding. The vibrating diaphragm 32 is a silicone vibrating diaphragm. The vibrating assembly further comprises a dome 30 which is combined with the inner edge of the vibrating diaphragm 32 by injection molding. The voice coil 34 is fixed to one side of the dome 30 close to the magnetic circuit system. The magnetic circuit system comprises a magnetic conduction plate 48. An inner magnet 46 and an inner washer 42 are sequentially fixed in the middle of the inner side of the magnetic conduction plate 48. Both the inner magnet 46 and the inner washer 42 are rectangular. A strip-shaped lateral magnet 44 is respectively fixed to the edges of the magnetic conduction plate 48 located at two sides of the longer side of the inner magnet 46 and the inner washer 42. An annular lateral washer 40 is fixed on the two lateral magnets 44 jointly. The external dimension of the lateral washer 40 is consistent with that of the magnetic conduction plate 48. The inner magnet 46 and the inner washer 42 form an inner magnetic circuit of the magnetic circuit system. The lateral magnets 44 and the lateral washer 40 form an outer magnetic circuit of the magnetic circuit system. A magnetic gap is provided between the inner magnetic circuit and the outer magnetic circuit. One end of the voice coil 34 is located in the magnetic gap. The lead 340 of the voice coil 34 is electrically connected with an external circuit of the miniature speaker through an electric connector 60 at the lower end of the second housing body 20. The voice coil 34 reciprocates upwards and downwards within the magnetic gap according to the sizes and directions of acoustic electric signals transmitted from the electric connector 60. The vibrating diaphragm 32 and the dome 30 vibrate upwards and downwards along with the vertical movement of the voice coil 34 to stir air to generate sound, thereby finishing the energy conversion between electrics and acoustics.

As shown in FIG. 1, supporting portions 400 which extend towards the magnetic conduction plate 48 are arranged in the middle of each of the edges at two opposite sides of the lateral washer 40, where no lateral magnet 44 is arranged, on the magnetic conduction plate 48. The supporting portions 400 are perpendicular to the lateral washer 40. The positions, which correspond to the supporting portions 400, at the edges of two opposite sides of the magnetic conduction plate 48 are respectively provided with a notch 482. The width of the notch 482 is consistent with the width of the supporting portion 400. The depth of the notch 482 is consistent with the thickness of the supporting portion 400. The end parts of the supporting portions 400 are fixed in the notches 482 after the magnetic circuit system is combined, such that the strength of the magnetic circuit system can be increased.

As shown in FIG. 1, the leads 340 of the voice coil 34 are routed along the short edges of two sides of the voice coil 34, and a sunken make-way portion 480 is respectively arranged in a position corresponding to the routing of each of the two leads 340 on the magnetic conduction plate 48, that is to say, a make-way portion 480 is respectively arranged on two sides, where no lateral magnet is arranged, of the magnetic conduction plate 48. The make-way portions 480 can effectively prevent the leads 340 from colliding with the magnetic conduction plate 48 when the voice coil 34 moves upwards and downwards, thereby greatly reducing the noise and other related defects of the miniature speaker and effectively improving the acoustic performance of the miniature speaker.

According to the present invention, the waterproof performance of the miniature speaker is greatly promoted by additionally arranging the soft sealing member between the two housing bodies, such that the miniature speaker can meet the requirements of the waterproof test of high pressure intensity. Meanwhile, the miniature speaker also acts as a buffer when it is installed in the portable electronic device, such that the miniature speaker and the portable electronic device are closely attached to each other, and the waterproof performance of the portable electronic device can be improved. Meanwhile, the production efficiency and the appearance aesthetics can also be improved.

The above embodiment of the present invention is merely an illustration of the technical solution thereof to improve the waterproof performance by additionally arranging the sealing member between the two housing bodies. The housing bodies and the internal structure of the miniature speaker are not limited to those described in the above embodiments, and the number of housing bodies constituting the miniature speaker housing is also not limited to the two housing bodies described above, but may be three housing bodies. The technical solution of the present invention can be applicable to the sealing between the housing bodies of any one of the miniature speakers. According to the description of the above embodiments, those skilled in the art can apply the technical solution of the present invention to miniature speakers of other structures without any creative work. Therefore, no matter whether the other structure of the miniature speaker is the same as that of the above embodiment, any product used to improve the waterproof performance of the miniature speaker, as long as the sealing element is additionally arranged between the two housing bodies, will fall into the protection scope of the invention.

The naming of the first housing body and the second housing body involved in this description is only for distinguishing the technical features and does not represent the positional relationship, the assembly order, the work order, and the like.

The present invention is not limited to the above-described specific embodiments, and various changes that have been made by those skilled in the art from the above-mentioned concepts and without creative work are within the scope of the present invention.

What is claimed is:

1. A miniature speaker, comprising:

a first housing body;

a second housing body, wherein the first housing body and the second housing body are combined together to form a space;

a vibrating system;

a magnetic circuit system, wherein the vibrating system and the magnetic circuit system are accommodated in the space defined by the first housing body and the second housing body, and wherein a sidewall at an end of the second housing body, which is combined with the first housing body, surrounds a periphery of the first housing body;

a gap provided between an outer edge of the first housing body and an inner side of the sidewall at the end of the second housing body; and a sealing member, wherein the sealing member is configured to cover an outer side of the first housing body, and wherein an edge of the sealing member is located in the gap such that the gap between the first housing body and the second housing body is sealed, wherein:

a steel sheet is arranged in a position, which corresponds to the vibrating system of the first housing body;

the sealing member is configured to cover an outer side of the steel sheet;

a melting temperature of the material of the sealing member is lower than that of a material of the first housing body and the second housing body; and an outer surface of the first housing body is lower than an end surface of the sidewall of the second housing body, and an outer surface of the sealing member is flush with the end surface of the sidewall of the second housing body.

2. The miniature speaker according to claim 1, wherein the sealing member is formed through an injection molding process after the first housing body and the second housing body are combined.

3. The miniature speaker according to claim 2, wherein a recess portion is arranged at an edge of the inner surface of the first housing body, and a space for accommodating adhesive is formed between the recess portion and the second housing body.

4. The miniature speaker according to claim 1, wherein a combination portion, which is of an annular step structure, is arranged on an inner surface of the sidewall of the second housing body, and an ultrasonic wire which is ultrasonically combined with the second housing body is arranged in a position, which corresponds to the combination portion, of an inner surface of the first housing body.

5. The miniature speaker according to claim 1, wherein the sealing member is made of at least one of silicone, TPU, TPC, or TPR.

6. The miniature speaker according to claim 1, wherein the magnetic circuit system comprises:

a magnetic conduction plate;

an inner magnet;

a lateral magnet, wherein the inner magnet and the lateral magnet are fixed on the magnetic conduction plate;

an inner washer;

a lateral washer, wherein the inner washer and the lateral washer are respectively fixed on the inner magnet and the lateral magnet, and wherein the lateral washer is of an annular structure;

supporting portions, wherein the supporting portions extend towards the magnetic conduction plate arranged at edges of two opposite sides of the lateral washer; and a notch at an edge of the magnetic conduction plate, which corresponds to the supporting portions, wherein the notch is adaptive to an end part of the supporting portion.

7. The miniature speaker according to claim 1, wherein the vibrating system comprises:

a vibrating assembly, wherein the vibrating assembly is combined with the second housing body; and a voice coil, wherein the voice coil is fixed to one side of the vibrating assembly close to the magnetic circuit system, and wherein the vibrating assembly comprises a silicone vibrating diaphragm which is combined with the second housing body through an injection molding process.

8. The miniature speaker according to claim 7, wherein a sunken make-way portion is arranged in a position, which corresponds to a lead of the voice coil, of a magnetic conduction plate.

9. A miniature speaker, comprising:

a first housing body;

a second housing body, wherein the first housing body and the second housing body are combined together to form a space;

a vibrating system;

a magnetic circuit system, wherein the vibrating system and the magnetic circuit system are accommodated in the space defined by the first housing body and the second housing body, and wherein a sidewall at an end of the second housing body, which is combined with the first housing body, surrounds a periphery of the first housing body;

a gap provided between an outer edge of the first housing body and an inner side of the sidewall at the end of the second housing body; and a sealing member, wherein the sealing member is configured to cover an outer side of the first housing body, and wherein an edge of the sealing member is located in the gap such that the gap between the first housing body and the second housing body is sealed, wherein the magnetic circuit system comprises:

a magnetic conduction plate;

an inner magnet;

a lateral magnet, wherein the inner magnet and the lateral magnet are fixed on the magnetic conduction plate;

an inner washer;

a lateral washer, the inner washer and the lateral washer being respectively fixed on the inner magnet and the lateral magnet, the lateral washer having an annular structure;

supporting portions extending towards the magnetic conduction plate and being arranged at edges of two opposite sides of the lateral washer; and a notch at an edge of the magnetic conduction plate, which corresponds to the supporting portions, the notch being adaptive to an end part of the supporting portion.

10. The miniature speaker according to claim 9, wherein:

a steel sheet is arranged in a position, which corresponds to the vibrating system of the first housing body;

the sealing member is configured to cover an outer side of the steel sheet;

a melting temperature of the material of the sealing member is lower than that of a material of the first housing body and the second housing body; and an outer surface of the first housing body is lower than an end surface of the sidewall of the second housing body, and an outer surface of the sealing member is flush with the end surface of the sidewall of the second housing body.

11. The miniature speaker according to claim 9, wherein:

the sealing member is formed through an injection molding process after the first housing body and the second housing body are combined; and a recess portion is arranged at an edge of the inner surface of the first housing body, and a space for accommodating adhesive is formed between the recess portion and the second housing body.

12. The miniature speaker according to claim 9, wherein a combination portion, which is of an annular step structure, is arranged on an inner surface of the sidewall of the second housing body, and an ultrasonic wire which is ultrasonically combined with the second housing body is arranged in a position, which corresponds to the combination portion, of an inner surface of the first housing body.

13. The miniature speaker according to claim 9, wherein the sealing member is made of at least one of silicone, TPU, TPC, or TPR.

14. The miniature speaker according to claim 9, wherein:

the vibrating system comprises:

a vibrating assembly, wherein the vibrating assembly is combined with the second housing body; and a voice coil, wherein the voice coil is fixed to one side of the vibrating assembly close to the magnetic circuit system, and wherein the vibrating assembly comprises a silicone vibrating diaphragm which is combined with the second housing body through an injection molding process; and a sunken make-way portion is arranged in a position, which corresponds to a lead of the voice coil, of a magnetic conduction plate.

15. A miniature speaker, comprising:

a first housing body;

a second housing body, wherein the first housing body and the second housing body are combined together to form a space;

a vibrating system;

a magnetic circuit system, wherein the vibrating system and the magnetic circuit system are accommodated in the space defined by the first housing body and the second housing body, and wherein a sidewall at an end of the second housing body, which is combined with the first housing body, surrounds a periphery of the first housing body;

a gap provided between an outer edge of the first housing body and an inner side of the sidewall at the end of the second housing body; and a sealing member, wherein the sealing member is configured to cover an outer side of the first housing body, and wherein an edge of the sealing member is located in the gap such that the gap between the first housing body and the second housing body is sealed, wherein:

the sealing member is formed through an injection molding process after the first housing body and the second housing body are combined; and the magnetic circuit system comprises:

a magnetic conduction plate;

an inner magnet;

a lateral magnet, wherein the inner magnet and the lateral magnet are fixed on the magnetic conduction plate;

an inner washer;

a lateral washer, the inner washer and the lateral washer being respectively fixed on the inner magnet and the lateral magnet, the lateral washer having an annular structure;

supporting portions extending towards the magnetic conduction plate and being arranged at edges of two opposite sides of the lateral washer; and a notch at an edge of the magnetic conduction plate, which corresponds to the supporting portions, the notch being adaptive to an end part of the supporting portion.

16. The miniature speaker according to claim 15, wherein:

a steel sheet is arranged in a position, which corresponds to the vibrating system of the first housing body;

the sealing member is configured to cover an outer side of the steel sheet;

a melting temperature of the material of the sealing member is lower than that of a material of the first housing body and the second housing body; and an outer surface of the first housing body is lower than an end surface of the sidewall of the second housing body, and an outer surface of the sealing member is flush with the end surface of the sidewall of the second housing body.

17. The miniature speaker according to claim 15, wherein a recess portion is arranged at an edge of the inner surface of the first housing body, and a space for accommodating adhesive is formed between the recess portion and the second housing body.

18. The miniature speaker according to claim 15, wherein a combination portion, which is of an annular step structure, is arranged on an inner surface of the sidewall of the second housing body, and an ultrasonic wire which is ultrasonically combined with the second housing body is arranged in a position, which corresponds to the combination portion, of an inner surface of the first housing body.

19. The miniature speaker according to claim 15, wherein:

the vibrating system comprises:

a vibrating assembly, wherein the vibrating assembly is combined with the second housing body; and a voice coil, wherein the voice coil is fixed to one side of the vibrating assembly close to the magnetic circuit system, and wherein the vibrating assembly comprises a silicone vibrating diaphragm which is combined with the second housing body through an injection molding process; and a sunken make-way portion is arranged in a position, which corresponds to a lead of the voice coil, of a magnetic conduction plate.

* * * * *